US012781322B2

(12) United States Patent
Yao et al.

(10) Patent No.: US 12,781,322 B2
(45) Date of Patent: Nov. 3, 2026

(54) HIGH-STRENGTH AND HIGH-FATIGUE-LIFE STEEL FOR CABLE, AND WIRE ROD AND PREPARATION METHOD THEREFOR

(71) Applicant: BAOSHAN IRON & STEEL CO., LTD., Shanghai (CN)

(72) Inventors: Zan Yao, Shanghai (CN); Feng Jin, Shanghai (CN); Ziquan Yu, Shanghai (CN); Zongze Huang, Shanghai (CN); Sixin Zhao, Shanghai (CN); Haoyang Zhao, Shanghai (CN); Ruiyin Zhai, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 784 days.

(21) Appl. No.: 18/020,999

(22) PCT Filed: Aug. 16, 2021

(86) PCT No.: PCT/CN2021/112730
§ 371 (c)(1),
(2) Date: Feb. 13, 2023

(87) PCT Pub. No.: WO2022/037516
PCT Pub. Date: Feb. 24, 2022

(65) Prior Publication Data

US 2023/0295784 A1 Sep. 21, 2023

(30) Foreign Application Priority Data

Aug. 20, 2020 (CN) ..... 202010843374.5

(51) Int. Cl.

| | |
|---|---|
| ***C22C 38/24*** | (2006.01) |
| ***C21D 8/06*** | (2006.01) |
| ***C22C 38/00*** | (2006.01) |
| ***C22C 38/02*** | (2006.01) |
| ***C22C 38/04*** | (2006.01) |

(52) U.S. Cl.
CPC ..... *C22C 38/24* (2013.01); *C21D 8/06* (2013.01); *C22C 38/002* (2013.01); *C22C 38/02* (2013.01); *C22C 38/04* (2013.01); *C21D 2211/003* (2013.01); *C21D 2211/008* (2013.01)

(58) Field of Classification Search
None
See application file for complete search history.

(56) References Cited

U.S. PATENT DOCUMENTS

| | | | |
|---|---|---|---|
| 2013/0302204 | A1 | 11/2013 | Hasegawa et al. |
| 2014/0000767 | A1 | 1/2014 | Yamasaki et al. |
| 2017/0175221 | A1 | 6/2017 | Wang et al. |

FOREIGN PATENT DOCUMENTS

| | | | | | |
|---|---|---|---|---|---|
| CN | 102634730 | A | | 8/2012 | |
| CN | 103122437 | A | | 5/2013 | |
| CN | 105671443 | B | | 6/2016 | |
| CN | 109468530 | A | | 3/2019 | |
| CN | 109554631 | A | * | 4/2019 | ..... C22C 38/06 |
| CN | 109811266 | A | * | 5/2019 | |
| EA | 025937 | B1 | | 2/2017 | |
| EP | 3492616 | A1 | | 6/2019 | |
| JP | H04-311523 | A | | 11/1992 | |
| JP | 2000-119805 | A | | 4/2000 | |
| JP | 2002-275584 | A | | 9/2002 | |
| JP | 2018-162523 | A | | 10/2018 | |
| KR | 10-2011-0101231 | A | | 9/2011 | |
| RU | 2605033 | C1 | | 12/2016 | |
| WO | 2011/089782 | A1 | | 5/2013 | |
| WO | 2018/021574 | A1 | | 5/2019 | |
| WO | 2019/164015 | A1 | | 12/2020 | |

OTHER PUBLICATIONS

EP(SSER) dated Jan. 2, 2024 for EP App No. 21857611.4.
JPOA1 dated Apr. 2, 2024 for JP App No. 2023-508563.
JPOA2 dated Nov. 12, 2024 for JP App No. 2023-508563.
RU Search Report dated Nov. 25, 2024 for App No. 2023102795/05.
RU OA dated Nov. 25, 2024 for App No. 2023102795/05.
International Search Report for PCT/CN2021/112730 dated Dec. 22, 2021.
International Written Opinion for PCT/CN2021/112730 dated Nov. 10, 2021.

* cited by examiner

*Primary Examiner* — Anthony M Liang
(74) *Attorney, Agent, or Firm* — Lei Fang, Esq.; Smith Tempel Blaha LLC

(57) ABSTRACT

A high-strength and high-fatigue-life steel for a cable, which comprises, in addition to Fe, the following chemical elements in percentages by mass: 0.90-1.00% of C; 0.90-1.50% of Si; 0.25-0.58% of Mn; 0.20-1.00% of Cr; 0.03-0.12% of V; and 0.0008-0.0025% of Ca. In addition, further provided are a wire rod made of the high-strength and high-fatigue-life steel for a cable and a preparation method for the wire rod.

18 Claims, No Drawings

HIGH-STRENGTH AND HIGH-FATIGUE-LIFE STEEL FOR CABLE, AND WIRE ROD AND PREPARATION METHOD THEREFOR

CROSS-REFERENCE TO RELATED APPLICATIONS

This application is a 371 U.S. National Phase of PCT International Application No. PCT/CN2021/112730 filed on Aug. 16, 2021, which claims benefit and priority to Chinese patent application No. CN202010843374.5 filed on Aug. 20, 2020, the contents of each of the above listed applications are incorporated by reference herein in their entiries.

TECHNICAL FIELD

The present disclosure relates to, a wire rod and a preparation method for the same, in particular to a cable steel, a wire rod and a preparation method for the same.

BACKGROUND ART

Suspension bridges and cable-stayed bridges are currently the first choice in the design of long-span bridges over bays, canyons, and large rivers. Along with the development of society and technology, the span of suspension bridges and cable-stayed bridges is also continuously increasing. The span of suspension bridges built in the world is close to 2000 meters, and the span of cable-stayed bridges has exceeded 1000 meters. Along with the increase of the span of these bridges, higher requirements are imposed on the performances of galvanized steel wires which are a key raw material for bridge cables. Research on galvanized steel wires having an ultra-high strength of 2000 MPa or higher and high torsional performance for bridge cables has become the focus of attention.

A wire rod is a raw material for production of a high-strength steel wire for a bridge cable. A large-size wire rod can be processed into a cable wire eventually through processes such as drawing, galvanization, and stabilization. However, in order to accomplish the drawing process of a steel wire having a large area reduction rate, the wire rod first needs to have good drawability. In recent years, the continuous promotion of the strength level of steel wires for bridge cables drives the continuous promotion of the strength of wire rods. Alloy strengthening and microstructure refinement are the two most effective means to improve the strength of wire rods.

Many advanced iron and steel enterprises around the world have carried out a series of research work on the method for alloy strengthening of wire rods. For example, the KKP wire rod developed by a Japanese company is a high-strength sorbitized wire rod having good performances obtained by adding a small amount of chromium to the conventional SWRS82B, followed by Stelmor cooling. If the carbon content in the wire rod is further increased to 0.87%, and a small amount of microalloy element(s) is added at the same time, a wire rod having higher strength and less discreteness (called super KKP wire rod) will be obtained. Of course, many companies in Europe also use this method to produce high-strength wire rods for bridge cables, but the strength level of the steel wires produced from this type of wire rods is still low. Correspondingly, domestic researchers mainly adopt a design with a low-silicon alloy composition.

The strength of the material strength is increased by increasing elements C and Mn in the wire rod, and a steel material having a carbon content of 0.87% has been developed. Although the strength of the wire rod and steel wire can be improved, only the processing requirement of the 1860 MPa steel wire can be satisfied. The strength level of the steel wire is still low.

In addition, another important means to improve the strength of a wire rod is to provide a high-carbon wire rod with a highly sorbitized structure to achieve refinement of the structure. At present, high sorbitization of a wire rod is mainly accomplished by controlling post-rolling cooling. Nowadays, 95% of the wire rods in China are produced with the use of the Stelmor air-cooling process in which a finally rolled wire rod is water cooled first, and then achieves continuous structural transformation of sorbite at the air-cooling stage. The Stelmor cooling process has the problems of insufficient cooling capacity and poor temperature uniformity when it is used to produce large-size wire rods. These problems will affect further improvement of material performances. Although Japan's Nippon Steel Corporation has developed an in-line salt bath isothermal treatment DLP process that satisfies the requirements of sorbite transformation in wire rods, it still has the problems of high equipment investment and high maintenance cost.

For development of a galvanized steel wire for bridge cables, in addition to the need to increase the strength of the steel wire, it is also necessary for the steel wire to maintain high plasticity and toughness, and high torsional performance while the steel wire has high strength. At present, the method mainly used is to control the contents of P and S in the material within certain ranges respectively. Especially, the content of P in the alloy is controlled at 0.02% or lower, and its segregation in the solidification process is prevented, thereby attenuating the damage caused by P on the torsional performance of the steel wire. 10-500 ppm Zr is added to form fine $ZrO_2$ grains and improve segregation of the components in the core of the wire rod. 9-60 ppm B is added to improve the structure of a high-carbon steel wire rod. Element B that is solid dissolved in high-temperature austenite will segregate at grain boundaries. During the cooling process, it will prevent formation of pro-eutectoid ferrite, and promote precipitation of carbides, thereby optimizing the structure, so as to improve the torsional performance However, the strength is limited to a certain range in all cases.

It should be noted that due to the long construction period and huge investment of long-span bridges, the bridges are required to have a long service life, high safety and reliability. In order to prolong the service life of the bridges, the fatigue life of a galvanized steel wire for bridge cables also needs special attention.

In the prior art, the existing high-carbon wire rods can meet the processing requirements of 1670 MPa, 1770 MPa or even 1860 MPa high-strength and high-torsion galvanized steel wires for bridge cables, and the strength of some steel wires can even reach 2000 MPa. Although the strength of the steel wires has reached the standard, the torsional performance and fatigue life of the steel wires still need to be further improved.

As such, in order to solve the above problems, it's desired to obtain a high-strength and high-fatigue-life cable steel, a wire rod and a preparation method therefor. While high strength is guaranteed, the high-strength and high-fatigue-life cable steel also exhibits good plasticity and fatigue life. It can be used to prepare a wire rod. The steel wire obtained by drawing and galvanizing the wire rod can effectively meet the production requirements of large-span and long-life bridge cables.

SUMMARY

One object of the present disclosure is to provide a high-strength and high-fatigue-life cable steel. An appropriate chemical composition is designed for the high-strength and high-fatigue-life cable steel to ensure the performances of the steel plate. The high-strength and high-fatigue-life cable steel exhibits excellent performances. While high strength is guaranteed, it also has good plasticity and fatigue life. It can be effectively used to prepare a wire rod. The steel wire obtained by drawing and galvanizing the wire rod can effectively meet the production requirements of long-span and long-life bridge cables, and has good application prospect and application value.

In order to achieve the above object, the present disclosure proposes a high-strength and high-fatigue-life cable steel, comprising the following chemical elements in mass percentages besides Fe:

C: 0.90-1.00%;
Si: 0.90-1.50%;
Mn: 0.25-0.58%;
Cr: 0.20-1.00%;
V: 0.03-0.12%;
Ca: 0.0008-0.0025%.

Further, the high-strength and high-fatigue-life cable steel according to the present disclosure comprises the following chemical elements in mass percentages:

C: 0.90-1.00%;
Si: 0.90-1.50%;
Mn: 0.25-0.58%;
Cr: 0.20-1.00%;
V: 0.03-0.12%;
Ca: 0.0008-0.0025%;
a balance of Fe and other unavoidable impurities.

The principles for designing the various chemical elements in the technical solution of the present disclosure will be described in detail as follows:

C: In the high-strength and high-fatigue-life cable steel according to the present disclosure, element C is an essential chemical component that ensures the high strength of the steel material. The content of element C in the steel determines the volume fraction of cementite in the sorbite structure in the cable steel. Increasing the content of element C in the steel is conducive to formation of more cementite lamellas and a refined sorbite lamellar structure, so that the steel can acquire better deformation performance and work hardening performance. This is beneficial to increase of the strength of the steel wire in subsequent processing. Therefore, in order to ensure the quality of the steel, in the steel according to the present disclosure, the content of element C should be controlled at 0.90% or more. However, it should be noted that the content of element C in the steel should not be too high. As the content of element C in the steel increases, it's more difficult to control segregation during the smelting and continuous casting process, and especially, reticular cementite is formed and precipitates along grain boundaries, leading to sharply reduced plasticity and toughness of the material. As such, in the high-strength and high-fatigue-life cable steel according to the present disclosure, the mass percentage of element C is controlled at 0.90-1.00%.

Si: In the high-strength and high-fatigue-life cable steel according to the present disclosure, element Si is often added to the steel as a deoxygenating agent during the smelting process, and element Si solid-dissolved in the ferrite phase will significantly increase the strength of the steel. In addition, during the cooling phase transformation process of the steel, element Si will further be enriched at the interface between the ferrite phase and the cementite phase. When the steel wire that has been drawn at a large area reduction rate is degreased in a lead bath and hot-dip galvanized, the enrichment of element Si at the phase interface will slow down decomposition of large deformed cementite lamellas, so that the loss of the strength of the steel material can be reduced effectively. In order to ensure that the wire rod has high strength and the steel wire obtained after drawing has higher strength, the content of element Si in the steel should be controlled to be higher than 0.9%. However, if the content of element Si in the steel is too high, the plasticity of the steel will be reduced significantly, so that the material will be embrittled. As such, in the high-strength and high-fatigue-life cable steel according to the present disclosure, the mass percentage of element Si is controlled at 0.90-1.50%.

Of course, in some preferred embodiments, in order to obtain better implementation effects, the mass percentage of element Si may be controlled at 1.0-1.4%.

Mn: In the high-strength and high-fatigue-life cable steel according to the present disclosure, element Mn is also often added to the steel as a deoxygenating agent during the steelmaking process. At the same time, element Mn tends to combine with the harmful element S in the steel to form MnS, so that the harm of element S can be reduced. In addition, Mn is also a commonly used strengthening element in the steel. It mainly effectuates solid solution strengthening, so that the resulting alloy cementite has higher strength. Hence, it is necessary to control the content of element Mn in the steel to be higher than 0.25%. However, it should be noted that the content of element Mn in the steel should not be too high. When the content of element Mn in the steel is too high, the grains in the material are more prone to coarsening during the heating process, and it's more difficult to control the structure during controlled cooling, especially when the contents of C and Si in the material are high. In addition, element Mn also tends to promote segregation of residual elements. It is necessary to control the content of element Mn in the steel to less than 0.58%. As such, in the high-strength and high-fatigue-life cable steel according to the present disclosure, the mass percentage of element Mn is controlled at 0.25-0.58%.

Cr: In the high-strength and high-fatigue-life cable steel according to the present disclosure, the addition of element Cr helps to refine the lamellar sorbite structure in the steel, and at the same time increase the strength of cementite, thereby improving the strength and plasticity of the material effectively. In order to ensure that the benefits of element Cr can be utilized effectively, the content of element Cr in the steel should be higher than 0.20%. On the other hand, in order to prevent occurrence of abnormal martensite structure and reduce the difficulty of structure control, it is necessary to control the content of element Cr in the steel to be less than 1.00%. As such, in the high-strength and high-fatigue-life cable steel according to the present disclosure, the mass percentage of element Cr is controlled at 0.20-1.00%. In some embodiments, the mass percentage of element Cr is controlled at 0.30-1.00%, and Cr in Example 10 is adjusted to 0.2%.

Of course, in some preferred embodiments, in order to obtain better implementation effects, the mass percentage of element Cr may be controlled at 0.2-0.7%.

V: In the high-strength and high-fatigue-life cable steel according to the present disclosure, element V can effectuate micro-alloy strengthening. Precipitation of 5-50 nm nano-scale carbonitride(s) of element V is conducive to refinement of the structure of the cable steel, and conducive to pinning dislocations. While the strength and plasticity of the material are improved, the torsional performance of the finished steel will not be affected excessively. In addition, the addition of element V also helps to inhibit formation of reticular cementite at grain boundaries. However, if the content of element V in the steel is too high, the carbonitrides will be coarsened, and the material cost will be increased. As such, in the high-strength and high-fatigue-life cable steel according to the present disclosure, the mass percentage of element V is controlled at 0.03-0.12%.

Ca: In the high-strength and high-fatigue-life cable steel according to the present disclosure, element Ca helps to improve the plasticity of the inclusions in the steel, thereby increasing the aspect ratio of the inclusions in the steel for a finished cable and further improving the performances of the steel. As such, in the high-strength and high-fatigue-life cable steel according to the present disclosure, the mass percentage of element Ca is controlled at 0.0008-0.0025%.

Further, in the high-strength and high-fatigue-life cable steel according to the present disclosure, the mass percentages of the chemical elements satisfy at least one of the following: Si: 1.0-1.4%; Cr: 0.2-0.7%.

Further, in the high-strength and high-fatigue-life cable steel according to the present disclosure, a total content of the other unavoidable impurities is ≤0.1%, preferably ≤0.08%, more preferably ≤0.05%, wherein the contents of the impurity elements satisfy at least one of the following: Cu≤0.05%; Al≤0.004%; Ti≤0.003%; P≤0.015%; S≤0.010%; O≤0.0025%; N≤0.0045%.

In the above technical solution, Cu, Al, Ti, P, S, O, and N elements are all impurity elements in the steel. If the technical conditions permit, in order to obtain a steel material having better performances and better quality, the amount of impurity elements in the steel should be minimized.

Among the impurity elements, if the contents of elements P and S in the steel are too high, the brittleness of the steel will be increased, especially when segregation occurs. Therefore, in the high-strength and high-fatigue-life cable steel according to the present disclosure, the contents of elements P and S should be controlled at P≤0.015%, S≤0.010%.

In addition, it should be noted that an excessively high content of element Al in the steel will lead to poor plasticity of the inclusions, thereby degrading the performances and fatigue life of the steel wire. Therefore, in the high-strength and high-fatigue-life cable steel according to the present disclosure, the content of the impurity element Al is controlled at Al≤0.004%.

In some embodiments, in the high-strength and high-fatigue-life cable steel according to the present disclosure, the mass percentage of Cu is 0.005-0.05%; the mass percentage of Al is 0.0001-0.004%; and the mass percentage of Ti is 0.0005-0.003%.

Further, the high-strength and high-fatigue-life cable steel according to the present disclosure further comprises at least one of the following chemical elements:

Mo: 0.10-0.80%;

B: 0.0008-0.0012%;

Re: 0.0005-0.008%.

In the technical solution according to the present disclosure, in order to obtain better implementation effects and obtain a steel material having better quality and performances, elements Mo, B and Re may also be added to the high-strength and high-fatigue-life cable steel described in the present disclosure.

The addition of elements Mo and B to the steel helps to further improve the hardenability of the material, improve the sorbite structure of the steel material, and improve the plasticity, toughness and torsional performance while the strength of the material is increased. The addition of element Re to the steel can effectively improve the purity of the steel, reduce the number and size of inclusions, and thus reduce the influence of the inclusions on the fatigue life and torsional performance of the steel wire.

On the other hand, the addition of the above elements will increase the material cost. To balance the performances and the cost control, in the technical solution of the present disclosure, at least one of the above elements may be added preferably.

Further, in the high-strength and high-fatigue-life cable steel according to the present disclosure, the microstructure is dominated by refined sorbite structure. Particularly, the phase proportion (volume fraction) of sorbite is ≥95%. There is no obvious reticular cementite at grains boundaries or martensite structure in the microstructure. That is, the phase proportion of the reticular cementite at grains boundaries and martensite structure is ≤0.5%.

Further, in the high-strength and high-fatigue-life cable steel according to the present disclosure, an average interlamellar spacing of the sorbite structure is 40-260 nm.

Further, in the high-strength and high-fatigue-life cable steel according to the present disclosure, a carbon segregation index in the core is lower than 1.08.

Further, in the high-strength and high-fatigue-life cable steel according to the present disclosure, the microstructure further comprises precipitate of carbonitride(s) of V having a size of 5-50 nm.

Further, in the high-strength and high-fatigue-life cable steel according to the present disclosure, the inclusions have a size of <35 um, and the inclusions have an aspect ratio of >2.

Further, the high-strength and high-fatigue-life cable steel according to the present disclosure has a tensile strength of ≥1430 MPa. In some embodiments, the high-strength and high-fatigue-life cable steel according to the present disclosure has a tensile strength of 1445-1560 MPa.

Correspondingly, another object of the present disclosure is to provide a wire rod having excellent performances and good strength-plasticity matching ability. It can meet the processing requirements of drawing and galvanizing the high-strength steel wire. Its tensile strength is ≥1430 MPa, and its area reduction rate is >30%. In a preferred embodiment, the wire rod according to the present disclosure has a tensile strength of 1445-1560 MPa, and its area reduction rate is 32-40%.

The steel wire obtained by drawing, galvanizing and stabilizing the wire rod has a tensile strength of ≥2000 MPa, a torsion value of >8 cycles as measured on a 100 D gauge sample, and a fatigue life of >2.4 million cycles under a maximum stress of 0.45 $\sigma_b$. It can effectively meet the production requirements of long-span and long-life bridge cables. In a preferred embodiment, the steel wire obtained by drawing, galvanizing and stabilizing the wire rod has a tensile strength of 2020-2100 MPa, a torsion value of 12-24 cycles as measured on a 100 D gauge sample, and a fatigue life of 2.49-4.20 million cycles under a maximum stress of 0.45 $\sigma_b$. The chemical elements and their respective mass percentages in the steel wire are the same as the chemical elements and their respective mass percentages in the high-strength and high-fatigue-life cable steel according to the present disclosure.

In order to achieve the above object, the present disclosure proposes a wire rod that is made of the above high-strength and high-fatigue-life cable steel. The chemical elements and their respective mass percentages in the wire rod are the same as the chemical elements and their respective mass percentages in the high-strength and high-fatigue-life cable steel according to the present disclosure.

Further, the performances of the wire rod according to the present disclosure satisfy at least one of the following: tensile strength: ≥1430 MPa; area reduction rate: >30%; tensile strength of the steel wire made of the wire rod by drawing and galvanization: ≥2000MPa; torsion value of the steel wire: >8 cycles; fatigue life of the steel wire: >2.4 million cycles under a maximum stress of 0.45 $\sigma_b$. In a preferred embodiment, the performances of the wire rod satisfy: ≥1430 MPa; area reduction rate: >30%; tensile strength of the steel wire made of the wire rod by drawing and galvanization: ≥2000 MPa; torsion value of the steel wire: >8 cycles; fatigue life of the steel wire: >2.4 million cycles. In a further preferred embodiment, the performances of the wire rod satisfy: tensile strength: 1445-1560 MPa; area reduction rate: 32-40%; tensile strength of the steel wire made of the wire rod by drawing and galvanization: 2020-2200 MPa; torsion value of the steel wire: 12-24 cycles as measured on a 100 D gauge sample; fatigue life of the steel wire: 2.49-4.20 million cycles under a maximum stress of 0.45 $\sigma_b$.

Further, according to the present disclosure, there is further provided a steel wire which is obtained by drawing, galvanizing and stabilizing the wire rod described herein. The drawing, galvanizing and stabilization treatments are all conventional techniques in the art. The steel wire may have a diameter of 4-8 mm The steel wire according to the present disclosure has a tensile strength of ≥2000 MPa; a torsion value of >8 cycles, and a fatigue life of >2.4 million cycles; preferably a tensile strength of 2020-2100 MPa; a torsion value of 12-24 cycles as measured on a 100 D gauge sample, and a fatigue life of 2.49-4.20 million cycles under a maximum stress of 0.45 $\sigma_b$.

In addition, still another object of the present disclosure is to provide a manufacturing method for the above wire rod. The manufacturing method is simple in production, and the resulting wire rod has excellent performances. It has good strength-plasticity matching ability, and can meet the processing requirements of drawing and galvanization for producing a high-strength steel wire.

To achieve the above object, the present disclosure proposes a manufacturing method for the above wire rod, comprising steps:

(1) Smelting and casting;
(2) Rough rolling;
(3) High-speed wire rolling;
(4) Stelmor controlled cooling;
(5) Isothermal treatment: austenite heating temperature: 890-1050° C.; hold time: 6-20 min; isothermal treatment temperature: 530-600° C.

In the technical solution according to the present disclosure, in step (1), smelting may be performed in an electric furnace or a converter, and then refining may be performed outside the furnace. It should be noted that when refining is performed outside the furnace, an LF furnace plus a VD or RH degassing treatment process may be used, and the composition and amount of synthetic slag added during the smelting process are adjusted to control the content of impurity elements in the steel. The vacuum degassing time is controlled to be >20 min.

Further, in the manufacturing method according to the present disclosure, in step (1), the vacuum degassing time is controlled to be >20 min during the smelting process; and the carbon segregation index in the core of the blank is controlled to be less than 1.08 during the casting process.

In the above technical solution, in step (1), during the casting process, a bloom continuous casting machine may be used to cast the bloom, and the carbon segregation index in the core of the bloom is preferably controlled to be lower than 1.08 to ensure the quality and performances of the bloom.

In the above step (2), a twice-heating rolling process may be used to cog down the continuously cast bloom at a temperature of 1100-1250° C. into a 150-250 mm square billet. After ultrasonic flaw detection, magnetic powder flaw detection, grinding wheel polishing, supplemental magnetic particle flaw detection and polishing, the square billet is heated in a heating furnace. The heating temperature is controlled at 960-1150° C., and the hold time is controlled at 1.5-2.5 h.

In the above step (3), the rolling speed is controlled at 20-60 m/s. Further, the inlet temperature of the finishing rolling unit is controlled at 920-990° C., the inlet temperature of the reducing and sizing mill is 920-990° C. and the spinning temperature is 880-950° C.

In addition, it should be noted that in step (4), the air volume of the Stelmor line fan may be adjusted to control the structure transformation of the wire rod, and thus optimize the structure of the wire rod, so as to obtain a wire rod having better performances. Preferably, the size of the rolled wire rod is Φ10-15 mm Preferably, the air volumes of 14 fans on the Stelmor line are adjusted in the following ranges: fans F1-F8 have an air volume of 80-100%, fans F9-F12 have an air volume of 75-100%, and fans F13-F14 have an air volume of 0-45%.

In addition, in step (5), the isothermal treatment on the wire rod may be carried out by means of a lead bath or a salt bath.

Compared with the prior art, the high-strength and high-fatigue-life cable steel, the wire rod and the preparation method therefor have the following advantages and beneficial effects:

The chemical composition of the high-strength and high-fatigue-life cable steel according to the present disclosure is designed appropriately to ensure the performances of the material. While the high strength of the high-strength and high-fatigue-life cable steel is guaranteed, it also has good plasticity and fatigue life. It can be used to prepare a wire rod. The steel wire obtained by drawing and galvanizing the wire rod can effectively meet the production requirements of long-span and long-life bridge cables, and has good application prospect and application value.

The wire rod made of the high-strength and high-fatigue-life cable steel according to the present disclosure also has excellent performances. It has good strength-plasticity matching ability. It can meet the processing requirements of drawing and galvanizing the high-strength steel wire. Its tensile strength is ≥1430 MPa, and its area reduction rate is >30%. The steel wire obtained by drawing, galvanizing and stabilizing the wire rod has a tensile strength of ≥2000 MPa, a torsion value of >8 cycles as measured on a 100 D gauge sample, and a fatigue life of >2.4 million cycles under a maximum stress of 0.45 $\sigma_b$. It can effectively meet the production requirements of long-span and long-life bridge cables.

Accordingly, the manufacturing method according to the present disclosure is simple in production, and the resulting wire rod has excellent performances. It has good strength-plasticity matching ability, and can meet the processing requirements of drawing and galvanization for producing a high-strength steel wire.

DETAILED DESCRIPTION

The high-strength and high-fatigue-life cable steel, the wire rod and the preparation method therefor will be further explained and illustrated with reference to the specific examples. Nonetheless, the explanation and illustration are not intended to unduly limit the technical solution of the disclosure.

Examples 1-11 and Comparative Examples 1-3

The wire rods of Examples 1-11 were all made using the following steps:

(1) Smelting and casting were performed with the use of the chemical compositions shown in Table 1: after smelting in an electric furnace or a converter, refining was performed outside the furnace. An LF furnace plus a VD or RH degassing treatment process was used for the refining outside the furnace. The composition and amount of synthetic slag added during the smelting process were adjusted. The vacuum degassing time was controlled to be >20 min during the smelting process. A bloom continuous casting machine was used to cast a bloom. During the casting, the drawing speed, cooling and terminal soft reduction parameters were adjusted in the continuous casting to control the carbon segregation index in the core of the bloom to be lower than 1.08.

(2) Rough rolling: a twice-heating rolling process was used to cog down the continuously cast bloom at a temperature of 1100-1250° C. into a 150-250 mm square billet. After ultrasonic flaw detection, magnetic powder flaw detection, grinding wheel polishing, supplemental magnetic particle flaw detection and polishing, the square billet was heated in a heating furnace. The heating temperature was controlled at 960-1150° C., and the hold time was controlled at 1.5-2.5 h.

(3) High-speed wire rolling: the rolling speed was controlled at 20-60 m/s; the inlet temperature of the finishing rolling unit was controlled at 920-990° C.; the inlet temperature of the reducing and sizing mill was controlled at 920-990° C.; and the spinning temperature was controlled at 880-950° C.

(4) Stelmor controlled cooling: the size of the rolled wire rod was Φ10-15 mm After the wire rod was rolled, the structure transformation of the wire rod was controlled by adjusting the air volumes of fan components of the Stelmor line to optimize the structure of the wire rod. The air volumes of 14 fans on the Stelmor line were adjusted in the following ranges: fans F1-F8 had an air volume of 80-100%, fans F9-F12 had an air volume of 75-100%, and fans F13-F14 had an air volume of 0-45%.

(5) Isothermal treatment: isothermal treatment was performed on the wire rod in a lead bath or a salt bath, wherein the austenite heating temperature was 890-1050° C.; the hold time was 6-20 min; and the isothermal treatment temperature was 530-600° C.

It should be noted that the wire rods of Examples 1-11 according to the present disclosure were prepared using the above steps. The chemical compositions and related process parameters in these Examples all met the control requirements of the design specification according to the present disclosure. The comparative wire rods of Comparative Examples 1-3 were also made using the process including smelting and casting, rough rolling, high-speed wire rolling, Stelmor controlled cooling and isothermal treatment, but their chemical compositions and related process parameters did not all meet the design requirements according to the present disclosure.

In addition, it should be noted that the wire rods of Examples 1-11 were all made of the high-strength and high-fatigue-life cable steel according to the present disclosure.

Correspondingly, the wire rods of Comparative Examples 1-3 were made of the corresponding comparative steel. Table 1 lists the mass percentages of the chemical elements in the high-strength and high-fatigue-life cable steel in each of Examples 1-11 and in the comparative steel in each of Comparative Examples 1-3.

TABLE 1

(wt %, the balance is Fe and other unavoidable impurities except for Cu, Al, Ti, P, S, O and N)

| | Chemical elements | | | | | | | | | | | | | | | |
|---|---|---|---|---|---|---|---|---|---|---|---|---|---|---|---|---|
| No. | C | Si | Mn | Cr | Cu | Al | Ca | Ti | P | V | S | O | N | Mo | B | Re |
| Ex. 1 | 0.95 | 0.92 | 0.58 | 0.4 | 0.03 | 0.004 | 0.0008 | 0.001 | 0.007 | 0.03 | 0.005 | 0.0017 | 0.0041 | — | — | — |
| Ex. 2 | 0.90 | 1.1 | 0.43 | 0.35 | 0.01 | 0.001 | 0.0019 | 0.002 | 0.015 | 0.05 | 0.002 | 0.002 | 0.0045 | — | — | — |
| Ex. 3 | 0.96 | 1.45 | 0.25 | 0.7 | 0.005 | 0.0005 | 0.0021 | 0.0025 | 0.006 | 0.12 | 0.009 | 0.0019 | 0.0032 | — | — | — |
| Ex. 4 | 0.98 | 1.00 | 0.37 | 0.9 | 0.04 | 0.001 | 0.0025 | 0.003 | 0.006 | 0.03 | 0.010 | 0.0025 | 0.0035 | — | — | — |
| Ex. 5 | 0.95 | 1.05 | 0.44 | 1.0 | 0.01 | 0.0002 | 0.0008 | 0.0005 | 0.014 | 0.07 | 0.008 | 0.0002 | 0.0005 | — | — | — |
| Ex. 6 | 1.00 | 0.90 | 0.25 | 0.9 | 0.03 | 0.003 | 0.0009 | 0.003 | 0.011 | 0.09 | 0.0009 | 0.0008 | 0.0015 | — | — | — |
| Ex. 7 | 0.96 | 0.96 | 0.39 | 0.65 | 0.05 | 0.001 | 0.0010 | 0.0015 | 0.012 | 0.10 | 0.0005 | 0.0021 | 0.0045 | — | — | 0.0005 |
| Ex. 8 | 0.90 | 0.94 | 0.45 | 0.74 | 0.04 | 0.0017 | 0.0009 | 0.0025 | 0.002 | 0.05 | 0.002 | 0.0009 | 0.0023 | — | 0.0008 | — |
| Ex. 9 | 0.93 | 1.50 | 0.58 | 0.89 | 0.015 | 0.0001 | 0.001 | 0.002 | 0.001 | 0.06 | 0.009 | 0.0017 | 0.0015 | 0.10 | — | 0.0080 |
| Ex. 10 | 0.92 | 1.02 | 0.50 | 0.20 | 0.025 | 0.0009 | 0.0008 | 0.001 | 0.009 | 0.03 | 0.010 | 0.0019 | 0.0030 | 0.80 | — | 0.0015 |
| Ex. 11 | 0.96 | 0.91 | 0.39 | 0.38 | 0.035 | 0.003 | 0.0015 | 0.001 | 0.013 | 0.06 | 0.005 | 0.0024 | 0.0041 | — | 0.0012 | — |
| Comp. Ex. 1 | ***0.87*** | 0.95 | ***0.72*** | 0.9 | ***0.10*** | 0.001 | 0.0010 | 0.003 | 0.010 | ***0*** | 0.009 | 0.0023 | ***0.0055*** | — | — | — |
| Comp. Ex. 2 | 0.96 | ***0.37*** | 0.45 | 0.8 | ***0.08*** | ***0.030*** | ***0.0006*** | ***0.010*** | ***0.019*** | 0.10 | 0.010 | 0.0015 | 0.0045 | — | — | — |
| Comp. Ex. 3 | ***1.2*** | ***0.56*** | ***0.65*** | 0.4 | 0.04 | ***0.019*** | ***0.0030*** | ***0.004*** | ***0.016*** | 0.06 | 0.007 | ***0.0030*** | 0.0040 | — | — | — |

Table 2 lists the specific process parameters in the above steps for the wire rods of Examples 1-11 and the comparative wire rods of Comparative Examples 1-3.

TABLE 2

| | Step (1) | | Step (3) | | | | | | |
|---|---|---|---|---|---|---|---|---|---|
| No. | Vacuum degassing time controlled during smelting (min) | Carbon precipitation index at bloom core during casting | Rolling speed (m/s) | Inlet temperature of finishing rolling unit (° C.) | Inlet temperature of reducing and sizing mill (° C.) | Spinning temperature (° C.) | Austenite heating temperature (° C.) | Hold time (min) | Isothermal treatment temperature (° C.) |
| Ex. 1 | 25 | 1.05 | 20 | 920 | 920 | 880 | 890 | 6 | 540 |
| Ex. 2 | 22 | 1.01 | 25 | 950 | 940 | 890 | 900 | 10 | 530 |
| Ex. 3 | 30 | 1.05 | 35 | 990 | 990 | 950 | 1000 | 12 | 550 |
| Ex. 4 | 26 | 1.06 | 60 | 930 | 920 | 880 | 890 | 18 | 560 |
| Ex. 5 | 25 | 1.06 | 49 | 920 | 920 | 890 | 1050 | 16 | 570 |
| Ex. 6 | 25 | 1.06 | 20 | 950 | 940 | 890 | 1000 | 20 | 550 |
| Ex. 7 | 21 | 1.07 | 30 | 970 | 950 | 900 | 900 | 8 | 540 |
| Ex. 8 | 27 | 1.02 | 24 | 970 | 960 | 920 | 910 | 6 | 550 |
| Ex. 9 | 30 | 1.04 | 55 | 950 | 950 | 920 | 915 | 9 | 588 |
| Ex. 10 | 22 | 1.04 | 35 | 980 | 980 | 950 | 920 | 15 | 600 |
| Ex. 11 | 25 | 1.05 | 30 | 920 | 920 | 950 | 950 | 16 | 560 |
| Comp. Ex. 1 | ***18*** | ***1.09*** | 40 | 990 | 980 | ***960*** | 900 | 10 | 550 |
| Comp. Ex. 2 | ***17*** | ***1.08*** | 30 | 950 | ***900*** | 880 | ***880*** | 15 | 580 |
| Comp. Ex. 3 | ***19*** | 1.05 | 25 | 950 | ***910*** | 900 | ***1100*** | ***25*** | 560 |

The wire rods of Examples 1-11 and the comparative wire rods of Comparative Example 1-3 obtained were sampled, observed, analyzed and subjected to relevant performance tests. The observation results and performance test results obtained are listed in Table 3 and Table 4 respectively.

Table 3 lists the observation results of the wire rods of Examples 1-11 and the comparative wire rods of Comparative Examples 1-3.

TABLE 3

| No. | Wire rod dimension (mm) | Sorbitizing rate (%) | Interlamellar spacing of sorbite structure (nm) | Inclusion size (um) |
|---|---|---|---|---|
| Ex. 1 | 11 | 95 | 50 | 30 |
| Ex. 2 | 13 | 97 | 90 | 34 |
| Ex. 3 | 15 | 95 | 260 | 34 |
| Ex. 4 | 10 | 97 | 40 | 28 |
| Ex. 5 | 13 | 99 | 210 | 19 |
| Ex. 6 | 13.5 | 98 | 95 | 34 |
| Ex. 7 | 14 | 97 | 220 | 15 |
| Ex. 8 | 15 | 99 | 130 | 33 |
| Ex. 9 | 11.5 | 95 | 50 | 14 |
| Ex. 10 | 14 | 98 | 109 | 16 |
| Ex. 11 | 13 | 99 | 203 | 20 |
| Comp. Ex. 1 | 12 | 95 | 45 | 34 |
| Comp. Ex. 2 | 13 | 92 | 150 | 50 |
| Comp. Ex. 3 | 15 | 97 | 200 | 45 |

As shown by Table 3, it should be noted that the wire rods according to the present disclosure were all made of the high-strength and high-fatigue-life cable steel described in the present disclosure. Accordingly, in Examples 1-11, the microstructure of the high-strength and high-fatigue-life cable steel from which the wire rods of Examples 1-11 were made is dominated by the refined sorbite structure, and the phase proportion of sorbite is ≥95%. There is no obvious reticular cementite at grain boundaries or martensite structure in the microstructure. In addition, in Examples 1-11 according to the present disclosure, the lamellar spacing of the sorbite structure is 40-260 nm, and the carbon segregation index in the core is lower than 1.08.

In addition, it should be noted that in the high-strength and high-fatigue-life cable steel of each of Examples 1-11 according to the present disclosure, the microstructure further comprises precipitate of carbonitride(s) of V having a size of 5-50 nm.

Further, in the high-strength and high-fatigue-life cable steel of each of Examples 1-11 according to the present disclosure, the inclusions in the steel have a size of <35 um, and the inclusions have an aspect ratio of >2.

Table 4 lists the performance test results of the wire rods of Examples 1-11 and the comparative wire rods of Comparative Example 1-3, wherein the test method for tensile strength and area reduction rate is: GB/T 228.1-2010 Metallic Materials Tensile Testing Method of Test at Room Temperature.

TABLE 4

| No. | Tensile strength (MPa) | Area reduction rate (%) |
|---|---|---|
| Ex. 1 | 1520 | 37 |
| Ex. 2 | 1450 | 32 |
| Ex. 3 | 1490 | 36 |
| Ex. 4 | 1500 | 36 |
| Ex. 5 | 1480 | 33 |
| Ex. 6 | 1570 | 33 |
| Ex. 7 | 1536 | 32 |
| Ex. 8 | 1445 | 33 |
| Ex. 9 | 1526 | 35 |
| Ex. 10 | 1519 | 40 |
| Ex. 11 | 1560 | 34 |
| Comp. Ex. 1 | 1370 | 35 |
| Comp. Ex. 2 | 1382 | 33 |
| Comp. Ex. 3 | 1510 | 29 |

It should be noted that the wire rods of Examples 1-11 and the comparative wire rods of Comparative Examples 1-3 that were sampled above can be subjected to 6-9 passes of drawing, steel wire galvanization and stabilization, and steel wires having better performances and quality can be obtained. The steel wires obtained from Examples 1-11 and the comparative steel wires obtained from Comparative Examples 1-3 were tested for various performances. The performance test results obtained are listed in Table 5.

Table 5 lists the performance test results of the steel wires obtained from Examples 1-11 and the comparative steel wires obtained from Comparative Examples 1-3, wherein the test method for tensile strength is: GB/T 228.1-2010 Metallic Materials Tensile Testing Method of Test At Room Temperature; the test method for torsion value is: GB/T239.1-2012 Metallic Materials Wire Part 1: Simple Torsion Test; the method for fatigue test is: GB/T 3075-200 Metallic Materials Fatigue Testing Axial-Force-Controlled Method.

TABLE 5

| No. | Tensile strength (MPa) | Torsion value (cycles) | Steel wire fatigue life ($10^4$ cycles) |
|---|---|---|---|
| Ex. 1 | 2098 | 12 | 249 |
| Ex. 2 | 2020 | 24 | 305 |
| Ex. 3 | 2056 | 20 | 298 |
| Ex. 4 | 2078 | 19 | 277 |
| Ex. 5 | 2051 | 18 | 314 |
| Ex. 6 | 2065 | 18 | 255 |
| Ex. 7 | 2030 | 19 | 419 |
| Ex. 8 | 2076 | 22 | 290 |
| Ex. 9 | 2034 | 18 | 287 |
| Ex. 10 | 2055 | 24 | 266 |
| Ex. 11 | 2100 | 17 | 381 |
| Comp. Ex. 1 | 1860 | 20 | 270 |
| Comp. Ex. 2 | 2010 | 10 | 233 |
| Comp. Ex. 3 | 2050 | 3 | 157 |

As it can be seen from Table 4 and Table 5, the performances of the comparative wire rods of Comparative Examples 1-3 and the steel wires made therefrom are obviously inferior in comparison with Examples 1-11. In the present disclosure, the wire rods of Examples 1-11 all have good performances. The tensile strength is ≥1430 MPa, and the area reduction rate is >30% for all of the wire rods.

The steel wires obtained by drawing and galvanizing the above wire rods have a tensile strength of ≥2000 MPa, a torsion value of >8 cycles as measured on a 100 D gauge sample, and a fatigue life of >2.4 million cycles under a maximum stress of 0.45 $\sigma_b$.They can effectively meet the production requirements of long-span and long-life bridge cables.

As it can be seen, the wire rods according to the present disclosure can be used to produce bridge cable steel wires having a strength of 2000 MPa or higher after drawing and galvanization. At present, the span of cable-stayed bridges has exceeded 1000 meters, and the span of suspension bridges is close to 2000 meters. As the bridge span increases, in order to reduce construction costs and save materials, it is necessary to use high-strength galvanized steel wire cables to increase the service life of bridges. The market prospect of the wire rod according to the present disclosure is very broad. It has good popularization and application value, and can bring huge economic benefits.

In addition, the ways in which the various technical features of the present disclosure are combined are not limited to the ways recited in the claims of the present disclosure or the ways described in the specific examples. All the technical features recited in the present disclosure may be combined or integrated freely in any manner, unless contradictions are resulted.

It should also be noted that the Examples set forth above are only specific examples according to the present disclosure. Obviously, the present disclosure is not limited to the above Examples. Similar variations or modifications made thereto can be directly derived or easily contemplated from the present disclosure by those skilled in the art. They all fall in the protection scope of the present disclosure.

What is claimed is:

1. A cable steel, consisting of the following chemical elements in mass percentages:

C: 0.90-1.00%;
Si: 0.90-1.50%;
Mn: 0.25-0.58%;
Cr: 0.20-1.00%;
V: 0.03-0.12%;
Ca: 0.0008-0.0025%; and
a balance of Fe and unavoidable impurities.

2. The cable steel according to claim 1, wherein the mass percentages of the chemical elements satisfy at least one of the following: Si: 1.0-1.4%; Cr: 0.2-0.7%.

3. The cable steel according to claim 1, wherein a total content of the unavoidable impurities is ≤0.10%, wherein contents of the impurities satisfy at least one of the following: Cu≤0.05%; Al≤0.004%; Ti≤0.003%; P≤0.015%; S≤0.010%; O≤0.0025%; N≤0.0045%.

4. A cable steel consisting of the following chemical elements in mass percentages:

C: 0.90-1.00%;
Si: 0.90-1.50%;
Mn: 0.25-0.58%;
Cr: 0.20-1.00%;
V: 0.03-0.12%;
Ca: 0.0008-0.0025%;
Mo: 0.10-0.80%;
B: 0.0008-0.0012%;
Re: 0.0005-0.008%; and
a balance of Fe and unavoidable impurities.

5. The cable steel according to claim 1, wherein its microstructure is dominated by refined sorbite structure, wherein a phase proportion of sorbite is ≥95%, and a phase proportion of reticular cementite at grains boundaries and martensite structure is ≤0.5%; and/or the microstructure further comprises precipitate of carbonitride(s) of V having a size of 5-50 nm; and/or inclusions in the microstructure have a size of <35 um and an aspect ratio of >2.

6. The cable steel according to claim 5, wherein a carbon segregation index in its core is lower than 1.08.

7. The cable steel according to claim 1, wherein the cable steel has a tensile strength of ≥1430 MPa.

8. A wire rod made of the cable steel according to claim 1.

9. A steel wire made by drawing, galvanizing and stabilizing the wire rod according to claim 8.

10. A manufacturing method for the cable steel according to claim 1, comprising the following steps:

(1) smelting and casting;
(2) rough rolling;
(3) high-speed wire rolling;
(4) Stelmor controlled cooling;
(5) isothermal treatment: austenite heating temperature: 890-1050° C.; holding time: 6-20 min; isothermal treatment temperature: 530-600° C.

11. The manufacturing method according to claim 10, wherein in step (1), a vacuum degassing time is controlled to be >20 min during the smelting; and a carbon segregation index in a billet core is controlled to be less than 1.08 during the casting.

12. The manufacturing method according to claim 10, wherein in step (2), a twice-heating rolling process is used to cog down a continuously cast bloom at a temperature of 1100-1250° C. into a 150-250 mm square billet, and then the square billet is heated in a heating furnace, wherein a heating temperature is controlled at 960-1150° C., and a hold time is controlled at 1.5-2.5 h.

13. The manufacturing method according to claim 10, wherein in step (3), a rolling speed is controlled at 20-60 m/s.

14. The manufacturing method according to claim 10, wherein in step (4), air volumes of 14 fans on a Stelmor line are adjusted in the following ranges: fans F1-F8 have an air volume of 80-100%, fans F9-F12 have an air volume of 75-100%, and fans F13-F14 have an air volume of 0-45%.

15. The cable steel according to claim 5, wherein an average interlamellar spacing of the sorbite structure is 40-260 nm.

16. The wire rod according to claim 8, wherein performances of the wire rod satisfy at least one of the following: tensile strength: ≥1430 MPa; area reduction rate: >30%; tensile strength of a steel wire made of the wire rod by drawing and galvanization: ≥2000MPa; torsion value of the steel wire: >8 cycles; fatigue life of the steel wire: >2.4 million cycles.

17. The steel wire according to claim 9, wherein the steel wire has a tensile strength of ≥2000 MPa; a torsion value of >8 cycles as measured on a 100D gauge sample, and a fatigue life of >2.4 million cycles under a maximum stress of 0.45σb.

18. The steel wire according to claim 9, wherein the steel wire has a tensile strength of 2020-2100 MPa; a torsion value of 12-24 cycles as measured on a 100D gauge sample, and a fatigue life of 2.49-4.20 million cycles under a maximum stress of 0.45σb.

* * * * *